US008276792B2

(12) United States Patent
Finlay et al.

(10) Patent No.: US 8,276,792 B2
(45) **Date of Patent: *Oct. 2, 2012**

(54) DISPENSER HAVING A CONICAL VALVE ASSEMBLY

(75) Inventors: Patrick J Finlay, Fairflied, CT (US); Kenneth A Ritsher, Chicago, IL (US); James M Collins, Arlington, PA (US)

(73) Assignee: PepsiCo, Inc., Purchase, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/537,619

(22) Filed: Aug. 7, 2009

(65) Prior Publication Data

US 2009/0294487 A1 Dec. 3, 2009

Related U.S. Application Data

(63) Continuation of application No. 11/081,108, filed on Mar. 16, 2005, now Pat. No. 7,584,874.

(60) Provisional application No. 60/553,551, filed on Mar. 17, 2004.

(51) Int. Cl.
*B65D 47/20* (2006.01)

(52) U.S. Cl. ..... 222/506; 222/505; 222/509; 222/511; 222/518; 137/614.19; 137/614.11; 251/243

(58) Field of Classification Search ..... 222/505, 222/506, 509, 511, 518, 472, 544–545, 394, 222/399, 559, 402.13, 402.15; 251/243–246, 251/263, 291, 321–323, 354; 137/614, 614.11, 137/614.13, 614.19, 322

See application file for complete search history.

(56) References Cited

U.S. PATENT DOCUMENTS

| | | | | | |
|---|---|---|---|---|---|
| 257,658 | A | * | 5/1882 | Del Nero | 241/238 |
| 294,674 | A | * | 3/1884 | Richter | 137/630.22 |
| 1,376,868 | A | * | 5/1921 | Gibson | 137/223 |
| 1,580,618 | A | * | 4/1926 | Lovequist et al. | 137/630.22 |
| 2,574,534 | A | | 11/1951 | Mateu | |
| 2,620,817 | A | * | 12/1952 | Blaydes | 137/322 |
| 2,888,040 | A | | 5/1959 | Terwilliger | |
| 2,899,170 | A | | 8/1959 | Cornelius | |
| 3,238,963 | A | | 3/1966 | Witzel | |
| 3,612,354 | A | | 10/1971 | Sitton | |
| 3,863,673 | A | * | 2/1975 | Sitton | 137/614.11 |
| 4,078,578 | A | | 3/1978 | Buchholz | |
| 4,130,119 | A | * | 12/1978 | Sessions et al. | 606/195 |
| 4,354,523 | A | * | 10/1982 | Hochmuth et al. | 137/614.18 |
| 4,509,554 | A | * | 4/1985 | Failla | 137/614.05 |
| 4,591,298 | A | * | 5/1986 | Fukumori et al. | 405/282 |
| 4,671,436 | A | | 6/1987 | Hagan | |
| 4,739,901 | A | | 4/1988 | Dorfman | |
| 4,982,879 | A | | 1/1991 | Corrado | |
| 4,995,534 | A | | 2/1991 | Norman | |
| 5,465,754 | A | * | 11/1995 | Sudo et al. | 137/614.2 |
| 6,089,268 | A | * | 7/2000 | Troiani et al. | 137/614.11 |
| 6,633,642 | B1 | * | 10/2003 | Oakley | 379/405 |

* cited by examiner

*Primary Examiner* — Kevin P Shaver
*Assistant Examiner* — Robert Nichols, II
(74) *Attorney, Agent, or Firm* — Banner & Witcoff, Ltd.

(57) ABSTRACT

A dispenser includes a dispenser body which defines a flow passage, a valve assembly, and an actuator. The valve assembly is disposed in the flow passage and includes a first valve member and a second valve member. An actuator is coupled to the valve assembly. When the actuator is manipulated through a first range of motion, only the first of the two valve members is displaced, and when the actuator is manipulated through a second range of motion, both the first and second valve members are displaced in unison.

21 Claims, 6 Drawing Sheets

DISPENSER HAVING A CONICAL VALVE ASSEMBLY

RELATED APPLICATION

This application claims the benefit of, and is a continuation of, prior U.S. application Ser. No. 11/081,108, filed Mar. 16, 2005, issued as U.S. Pat. No. 7,584,874 issued on Sep. 8, 2009, which claims the benefit of U.S. Provisional Application No. 60/553,551 filed Mar. 17, 2004, both of which applications are incorporated in their entirety into the present application fully by reference and made a part thereof.

BACKGROUND

Post-mix fountains for dispensing carbonated beverages, such as sodas, have been used for years in various venues, such as convenience stores and restaurants. Post-mix fountains combine the ingredients of the carbonated beverage (e.g., syrup or concentrate and carbonated water) immediately prior to the beverage is dispensed into a glass. Such fountains are convenient and economical because they allow the convenience store or restaurant owner to purchase large quantities of syrup or concentrate and carbon dioxide used to make the beverage at bulk prices. Furthermore, less waste is produced and less space is used up by packaging, since the ingredients of the fountain beverage come in large containers, rather than smaller containers sold to consumers, such as, for example, twelve ounce beverage cans or two liter bottles. In addition, the fountain is convenient for uses to operate, because there is no need to open bottles or cans to fill a glass with beverage. One of the benefits of post-mix fountains is their ability to dispense each poured serving of beverage at a uniform carbonation level, typically using the carbonation level of a bottled or canned beverage as a reference.

These fountains typically require a separate canister of gas, such as carbon dioxide gas, to carbonate water that is mixed with the syrup to form the beverage, and to propel or pump the syrup from its container. Although this arrangement is appropriate for large-scale users such as convenience stores and restaurants, it is less advantageous for smaller-scale users, such as home users. However, home users can still realize many of the benefits of fountains, particularly the lower cost, reduced waste, and ease of use that such fountains offer.

Seltzer bottles for dispensing seltzer water from a bottle are also known in the art. These seltzer bottles typically use the carbonation of the seltzer water itself to propel it from the bottle, and do not require an additional container of the seltzer water itself to propel it from the bottle, and do not require an additional container of carbon dioxide. However, there are several drawbacks associated with this type of seltzer dispenser. For instance, such seltzer bottles are difficult to control and often are discharged with substantial force, causing the seltzer water to spray out of control. When seltzer water is dispensed in this manner foaming may occur, which causes the dispensed seltzer water to lose some of its carbonation and become flat. Another drawback with this type of seltzer bottle is that the pressure in the seltzer bottle is often depleted before all the contents of the container have been dispensed. Thus, a residual amount of unused material remains in the bottle and cannot be dispensed because there is insufficient pressure remaining to propel the residual material from the container.

The present inventors found that the pressure within such conventional seltzer bottles fluctuates as the beverage is depleted. That is when the seltzer bottle is full, the pressure within the bottle is at a maximum. As the seltzer bottle becomes depleted, the pressure within the bottle becomes correspondingly depleted. Since the pressure within the seltzer bottle decreases during its use, it follows that the pressure available to propel the beverage out of the bottle decreases as well. Therefore, the beverage may be propelled out of the bottle too quickly when the bottle is full and/or too slowly when the bottle is less than full.

Conventional cans of carbonated beverages are relatively inexpensive, but have the disadvantage that once they are opened, they cannot be resealed. Once opened, the carbon dioxide or other gas dissolved in the beverage gradually comes out of solution or "leaks." Thus, if not consumed shortly after being opened cans of carbonated beverage will become flat. Accordingly, cans are not suitable for storing multiple servings of carbonated beverages.

Bottles are superior to cans in that they are able to be resealed after being opened, but when opened, the carbonation still escapes from the bottle. Thus, after a bottle has been opened several times, the beverage will begin to become flat. For this reason, even bottles are not well suited for containing multiple servings of carbonated beverages.

There is, therefore, a need in the art for a beverage dispenser that is inexpensive, easy for a home user to operate, and that eliminates the problems associated with the prior art dispensers, cans, and bottles. One exemplary embodiment of present invention is directed to remedying these and other deficiencies of the prior art dispensing devices.

SUMMARY OF THE INVENTION

Accordingly, the one exemplary embodiment of the present invention advantageously provides an easy-to-use dispenser that is capable of regulating the rate at which a liquid is dispensed from a pressurized container and prevents foaming of the dispensed liquid, while also allowing substantially all of the liquid to be dispensed from the container. The dispenser also maintains dissolved gas, such as carbon dioxide gas, in the liquid longer and to a greater extent than conventional dispensers, cans, and bottles.

In one aspect, the present invention relates to a dispenser for dispensing liquid. The dispenser comprises a dispenser body, which defines a flow passage, a valve assembly, and an actuator. The valve assembly is disposed in the flow passage and comprises a first valve member and a second valve member, which has an elongated contact surface to control the flow rate of the liquid. The actuator is coupled to the valve assembly. When the actuator is manipulated through a first range of motion, only the first valve member is displaced. When the actuator is manipulated through a second range of motion, both the first and second valve members are displaced in unison.

In another aspect, the present invention relates to a dispenser for dispensing a liquid. The dispenser comprises a container for holding the liquid and a dispenser body. The container has a neck with an opening. The dispenser body is received in the opening of the container and defines a flow passage. A valve assembly is disposed in the flow passage and comprises a first valve member, a second valve member, and a seal interposed between the first and second valve members. The seal is operable between an extended condition wherein the seal extends and seals against a peripheral wall of the flow passage and a retracted condition wherein the seal is retracted into a cavity formed between the first and second valve members. An actuator is mounted to a cap and coupled to the valve assembly. The cap has a spout protruding therefrom for directing the dispensed liquid. When the actuator is manipulated through a first range of motion, only the first valve member is displaced. When the actuator is manipulated through a second range of motion, both the first and second valve members are displaced in unison.

In yet another aspect, the present invention relates to a fluid flow controller. The fluid flow controller comprises a body, which defines a flow path, and a valve assembly. The valve assembly is disposed in the flow passage and includes a first valve member, a second valve member slidable relative to the first valve member, and a seal interposed between the first and second valve members. The seal is operable between an extended condition wherein the seal extends and seals against a peripheral wall of the flow passage to prevent fluid flow and a retracted condition wherein the seal is retracted into a cavity formed between the first and second valve members.

These and other features and advantages of the present invention will become apparent from the description of the preferred embodiments, with reference to the accompanying drawing figures.

BRIEF DESCRIPTION OF THE DRAWINGS

Throughout the drawings like or corresponding reference numerals denote like or corresponding features.

DETAILED DESCRIPTION OF THE EMBODIMENTS

One aspect of the present invention provides an easy-to-use dispenser that is capable of regulating the rate at which a liquid is dispensed from a pressurized container and prevents foaming of the dispensed liquid, while also allowing substantially all of the liquid to be dispensed from the container at a uniform carbonation level. The dispenser also maintains dissolved gas, such as carbon dioxide gas, in the liquid longer and to a greater extent than conventional dispensers, such as cans and bottles.

To accomplish these and other features, one exemplary embodiment of the present invention comprises a dispenser that is especially well-suited for dispensing a carbonated beverage from a container, using the pressure generated by carbonation in the carbonated beverage itself to propel the beverage out of the container. Thus, the dispenser assembly does not require any additional cumbersome tank of propellant and can be manufactured in a convenient size for home use. Alternatively, the dispenser assembly could be manufactured and sold as a separate kit for attachment to a conventional bottle, such as a two liter soda bottle. Moreover, the present inventors anticipate that the dispenser assembly may also be advantageously used in connection with non-carbonated liquids, using another method, such as a separate source of propellant or gravity to dispense the liquid from the container.

The dispenser could be manufactured and sold as a package with the container, or as a separate kit for attachment to a conventional bottle, such as a two liter soda bottle. Moreover, the present inventors anticipate that the dispenser may also be advantageously used in connection with various non-carbonated liquids and non-pressurized containers, as discussed further below.

Figure 1:
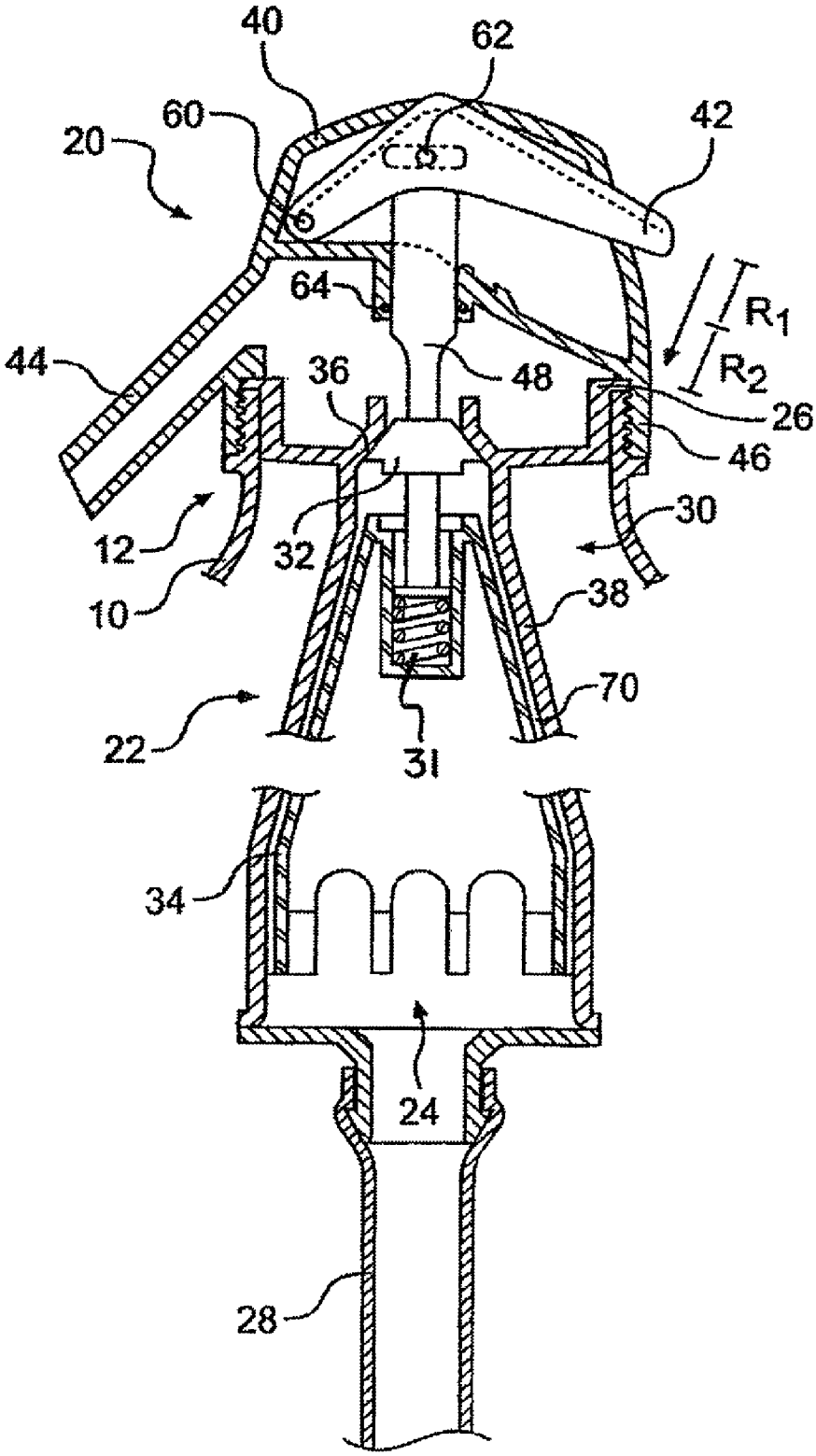
FIG. 1 is a partial cross-sectional view of a dispenser according to one embodiment of the present invention.
Figure 2:
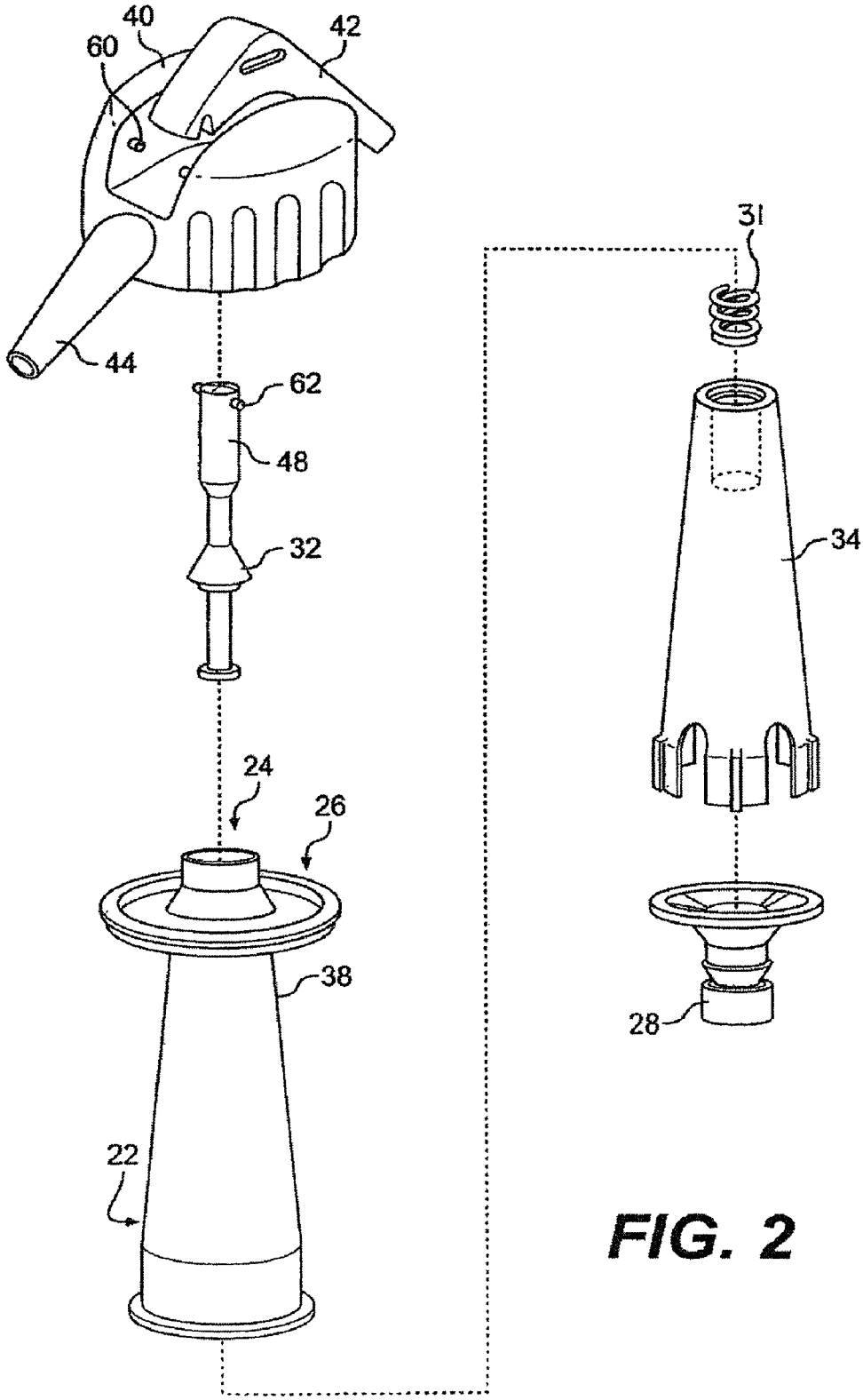
FIG. 2 is an exploded perspective view of the dispenser of FIG. 1.

FIGS. 1 and 2 depict a dispenser 20 according to a first embodiment of the present invention. The dispenser 20 generally comprises a dispenser body 22 defining a flow passage 24, through which liquid is allowed to flow during dispensing. The dispenser body 22 is positioned in the neck 12 of a container 10, and a flange 26 of the dispenser body 22 rides on the opening of the container 10. A cap 40 is attached to the container 10 and held in place by an attachment portion 46. The cap 40 has a spout 44, which directs the liquid as it is dispensed from the dispenser 20. The dispenser body 22 is fixed in place by being sandwiched between the cap 40 and the neck 12 of the container 10. A valve assembly 30 is disposed within the flow passage 24 to regulate and restrict the rate at which the liquid is dispensed from the container 10. A dip tube 28 is attached to the lower end of the dispenser body 22 to supply liquid held in the container 10 to the dispenser body 22 to be dispensed.

As best illustrated by FIG. 1, the valve assembly 30 is disposed in the flow passage 24 in order to regulate flow of the liquid during dispensing. Preferably, the valve assembly 30 is a two-stage valve assembly in which a first (sealing) valve member 32 is fully opened before a second (regulating) valve member 34 is actuated. This reduces turbulence and foaming of the liquid by preventing the liquid from flowing through the first valve member 32 when it is not fully open.

A spring 31 is preferably disposed between the first and second valve members 32, 34, to maintain the first valve member 32 in a closed position. A second spring (also not shown) may be positioned in the dispenser body 22 to bias the second valve member 34 in a closed direction, if necessary or desired to maintain the valve in a closed position.

The first valve member 32 is configured to engage a valve seat 36 formed on an inner surface of the valve body 22 to seal the flow passage 24 against flow of the liquid. The second valve member 34 is preferably greater in both diameter and length than the first valve member 32, and is configured to engage a peripheral wall 38 of the dispenser body 22. A space formed between the outer, elongated contact surface of the second valve member 34 and the peripheral wall 38 defines a restricted flow path 70. The second valve member 34 acts as a flow regulator to adjust the rate at which the liquid flows through the restricted flow path 70 during dispensing. The second valve member 34 also acts as a secondary seal to prevent flow of the liquid through the flow passage 24 when the second valve member 34 abuts the peripheral wall 38.

Preferably, the first and the second valve members 32, 34 are gradually tapered so as to provide a smooth transition of the liquid across the valve assembly 30. The valve seat 36 and the peripheral wall 38 of the dispenser body 22, preferably, correspond in shape to the first and second valve members 32, 34, respectively. In particular, the first and second valve members 32, 34 are preferably tapered—more preferably substantially conical—in shape so as to create a long, restricted flow path 70 between the valve members 32, 34 and the interior surface of the dispenser body 22, to smooth the transition of the liquid from the high pressure environment in the container 10 to the low-pressure ambient environment. Using this smooth transition across the valve assembly 30 prevents foaming of the dispensed liquid, thus, allowing the dispensed liquid to retain more carbonation or other dissolved gas(es). The first and second valve members 32, 34 are depicted in FIGS. 1 and 2 as each being a single conical or frustoconical body. However, it should be understood that each of these valve members could instead be constructed of multiple different pieces and/or constructed in various different sizes and shapes. For example, the first valve member 32 could also be made of a series of progressively larger o-ring type seals arranged in a stack. Moreover, the valve members 32, 34 could be made to be egg-shaped, pyramidal, or any other suitable shape. Preferably, however, the valve members provide a smooth flow transition across the valve assembly.

The valve assembly 30 is operable in accordance with the position of an actuator 42. The actuator 42 is coupled to the valve assembly 30 via an actuator guide rod 48, which extends through the cap 40. A guide seal 64 is provided in the cap 40 and surrounds the guide rod 48 to prevent the liquid from escaping at the point where the guide rod 48 passes through the cap 40. The guide rod 48 is connected to the actuator 42 by a pivot pin 62. The pivot pin 62 moves the guide rod 48 vertically as a user manipulates the actuator 42. In FIGS. 1 and 2, the actuator 42 is shown as an L-shaped lever, which pivots about a hinge pin 60 when it is depressed by a user. It should be understood, however, that other types and shapes of actuators, such as push buttons, pull-type levers, joystick-type levers, and the like, could alternatively be used.

The dispenser 20 may be already installed in the container 10 when it is purchased by a consumer or, alternatively, the dispenser 20 may be purchased separately and then installed by the consumer just prior to use. This second arrangement would allow the dispenser 20 to be used repeatedly on refill containers of the liquid, thereby reducing waste. Once the dispenser 20 is installed on the container 10, the user has simply to manipulate the actuator 42 to dispense the liquid.

The embodiment depicted in FIGS. 1 and 2, has an actuator 42 in the shape of an L. The user simply presses the actuator 42 downward as shown by the arrow in FIG. 1. As the actuator 42 is moved through a range of motion R1, the guide rod 48 is pressed vertically downward by a proportional amount, which in turn disengages the first valve member 32 from the valve seat 36. The lower end of the guide rod 48 is placed within a cavity formed in the upper end of second valve member 34. The second valve member does not move when the actuator is moved through the first range of motion R1, and continues to engage and seal against the peripheral wall 38 of the dispenser body 22. Thus, during the first range of motion R1, substantially no flow of the liquid is allowed.

As the user depresses the actuator through a second range of motion R2, the first valve member 32 abuts the second valve member 34, causing the second valve member 34 to disengage the peripheral wall 38. As the second valve member 34 moves, a long, restricted flow path 70 is created between the second valve member 34 and the peripheral wall 38. The rate at which liquid is allowed to flow through this restricted flow path 70 can be regulated by moving the actuator within the second range of motion R2 to adjust the spacing of the second valve member 34 from the peripheral wall 38 proportionally.

Because the first valve member 32 is fully opened before the second valve member 34 begins to move, the liquid is not allowed to flow through the first valve member 32 when it is cracked or only partially open. Allowing the liquid to flow through a cracked valve tends to cause undue turbulence to the liquid flow, which causes gas dissolved in the liquid to effervesce. This turbulence associated with a cracked valve is avoided with the second valve member 34, because the elongated contact surface between the second valve member 34 and the peripheral wall section 38 forms a long, restricted flow path 70 to smooth the transition from the high-pressure environment within the container to the low-pressure ambient environment. The present arrangement ensures that the second valve member 34, and not the first valve member 32, regulates the rate of liquid flow through the valve assembly 30, thereby smoothing the liquid flow path, reducing foaming, and retaining more dissolved gas in the dispensed liquid.

By restricting the rate of dispensation of the liquid, the flow of the beverage remains steady and is easily controlled by a user. Because the gas in the head-space of the container is never allowed to vent to the atmosphere during dispensing (i.e., because the dip tube is always submerged in the liquid contents), the liquid in the container retains its carbonation longer. Also, by restricting the rate of dispensing, the amount of foaming of the dispensed liquid is reduced and the liquid advantageously retains more of its carbonation "in the glass."

Figure 3:
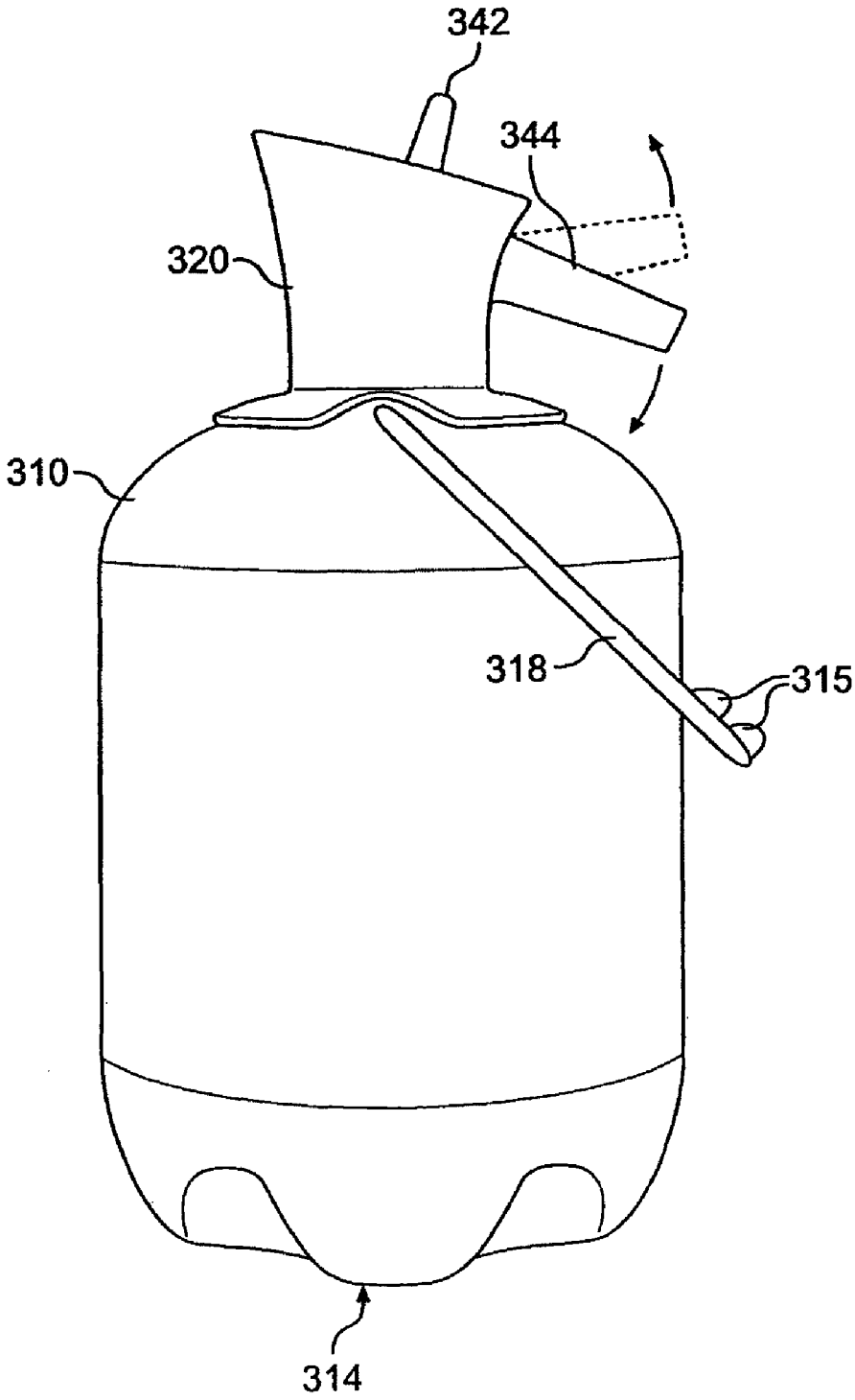
FIG. 3 is a side view of a dispenser according to another embodiment of the present invention.

FIG. 3 depicts a dispenser 320 according to another embodiment of the present invention. The dispenser 320 is shown attached to a container 310 of liquid. In this embodiment, the dispenser 320 has a joystick-type actuator 342, which is actuatable by movement in either the forward (right in FIG. 3) or backward (left in FIG. 3) direction. Alternatively, the actuator 342 could be actuatable by movement in any direction (front, back, side-to-side, etc.). The dispenser includes a spout 344, which is movable in order to direct the liquid as it is dispensed. This is especially important where, as here, the dispenser 320 is designed to be used in either a vertical (as pictured) or horizontal position. When the container is used in a vertical position, the spout 344 is adjusted to point somewhat downward and the container 310 sits on a first (bottom) supporting surface 314, as shown in FIG. 3. When the container is used in a horizontal position, as might be the case when stored in a refrigerator, the spout is adjusted to point somewhat upward (as shown in phantom lines) and the container 310 rests on its side and is supported by a second supporting surface or feet 315 formed on a handle 318. Thus, in the horizontal orientation, the handle 318 can be used to stabilize the container 310 to prevent it from tending to roll by providing the second support surface 315. It should be understood that the features of the adjustable spout and the handle with a second support surface could be advantageously used in connection with any of the other embodiments disclosed herein or known in the art.

Figure 4:
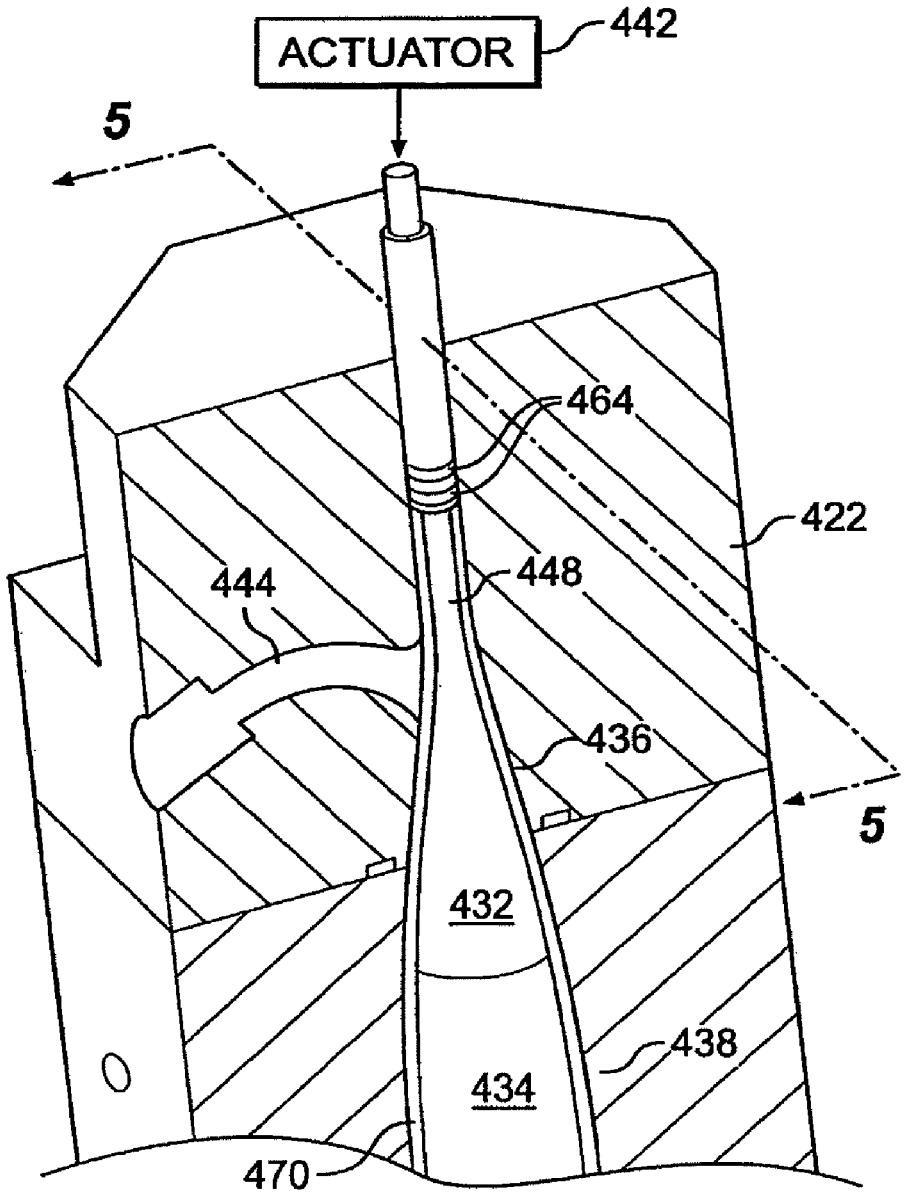
FIG. 4 is a partial cut-away, perspective view of a dispenser according to still another embodiment of the present invention.

FIG. 4 depicts a dispenser according to yet another embodiment of the present invention. The present inventors determined that several factors, such as rapid changes in cross-sectional area of the liquid flow path, changes in pressure, and changes in velocity tend to increase the amount of liquid foaming. This embodiment is similar to the first embodiment in many respects, but has been modified to address these factors. A dispenser according to this embodiment again comprises a dispenser body 422, a first (sealing) valve member 432, a second (regulating) valve member 434, and a spout 444 through which the liquid is dispensed. In this embodiment, however, the cross-sectional transition between the top of the second valve member 434 and the spout 444 is a smooth, gradual transition. In addition, this embodiment provides a more gradual change in flow direction of the dispensed liquid between the first valve member 432 and the spout 444. These two changes also result in a gradual change in pressure between the high pressure within the container and the ambient pressure outside the container.

As shown in FIG. 4, the interface between the first and second valve members 432, 434 is a smooth "seamless" interface. An actuator guide rod 448 is integrally formed at the upper end of the first valve member 432 to provide a smooth transition therebetween. The guide rod 448 extends upward through an aperture formed in the dispenser body 422 and is actuated by an actuator 442, shown schematically in FIG. 4. The actuator 442 might be, for example, a push button actuator, a lever actuator, a joystick actuator, or the like. A pair of guide seals 464 are positioned on the guide rod 448 to prevent liquid from leaking out the guide rod aperture in the dispenser body 422. A spring (not shown) is preferably disposed between the first and second valve members 432, 434, to maintain the first valve member 432 in a closed position. A second spring (also not shown) may be positioned in the dispenser body 422 to bias the second valve member 434 in a closed direction, if necessary or desired to maintain the valve in a closed position. To dispense the liquid, a user has simply to manipulate the actuator 442.

Figure 5C:
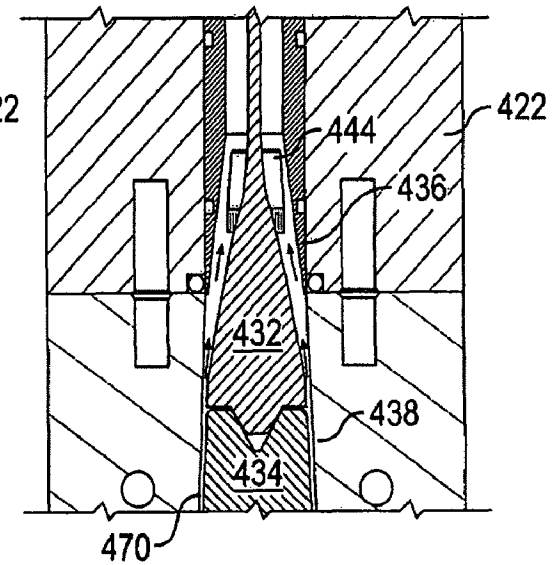
FIG. 5C is a partial cross-sectional view of the dispenser of FIG. 4, taken along line 5-5, showing the valve assembly of the dispenser in a third, open position.
Figure 5B:
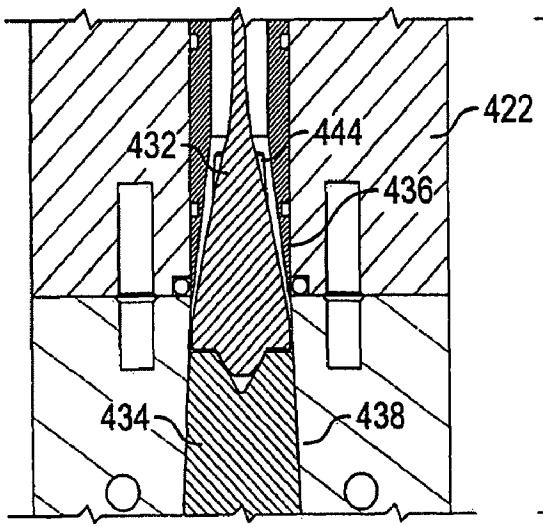
FIG. 5B is a partial cross-sectional view of the dispenser of FIG. 4, taken along line 5-5, showing the valve assembly of the dispenser in a second, partially open position.
Figure 5A:
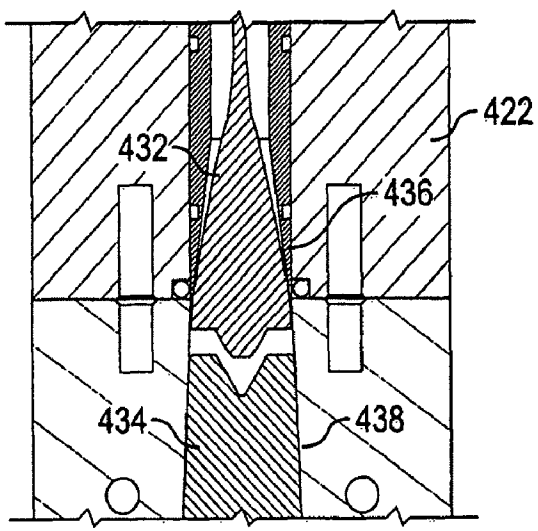
FIG. 5A is a partial cross-sectional view of the dispenser of FIG. 4, taken along line 5-5, showing a valve assembly of the dispenser in a first, closed position.

As in the first embodiment, the valve is a two-stage valve, such that the second valve member 434 does not begin to open until the first valve member 432 is fully open. FIGS. 5A-5C are cross-sectional views taken along line 5-5 in FIG. 4, and show the dispenser in different positions. FIG. 5A depicts the dispenser in a first, closed position. In this position, the first valve member 432 abuts and seals against a valve seat 436 formed on the interior of the valve body 422 and the second valve member 434 abuts and seals against a peripheral wall surface 438 of the valve body 422.

When a user depresses the actuator 442 through a first range of motion, the first valve member 432 is disengaged from the valve seat 436 and pressed toward the second valve member 434, as shown in FIG. 5B. In this position, the liquid is still prevented from flowing by the second valve member 434 seated against the peripheral wall surface 438.

As the user continues to depress the actuator 442 through a second range of motion, the first valve member 432 abuts the second valve member 434 and forces it away from the peripheral wall 438, as shown in FIG. 5C. During this second range of motion, liquid if allowed to flow through a restricted flow path 470 formed between the second valve member 434 and the peripheral wall 438 and out of spout 444, as shown by arrows in FIG. 5C. The distance that the second valve member 434 is spaced from the peripheral wall 438 determines the size of the restricted flow path 470 and, thus, regulates the rate of liquid flow through the dispenser. The spacing of the second valve member 434 can be adjusted by moving the actuator 442 within the second range motion.

Figures 6A, 6B, 6C:
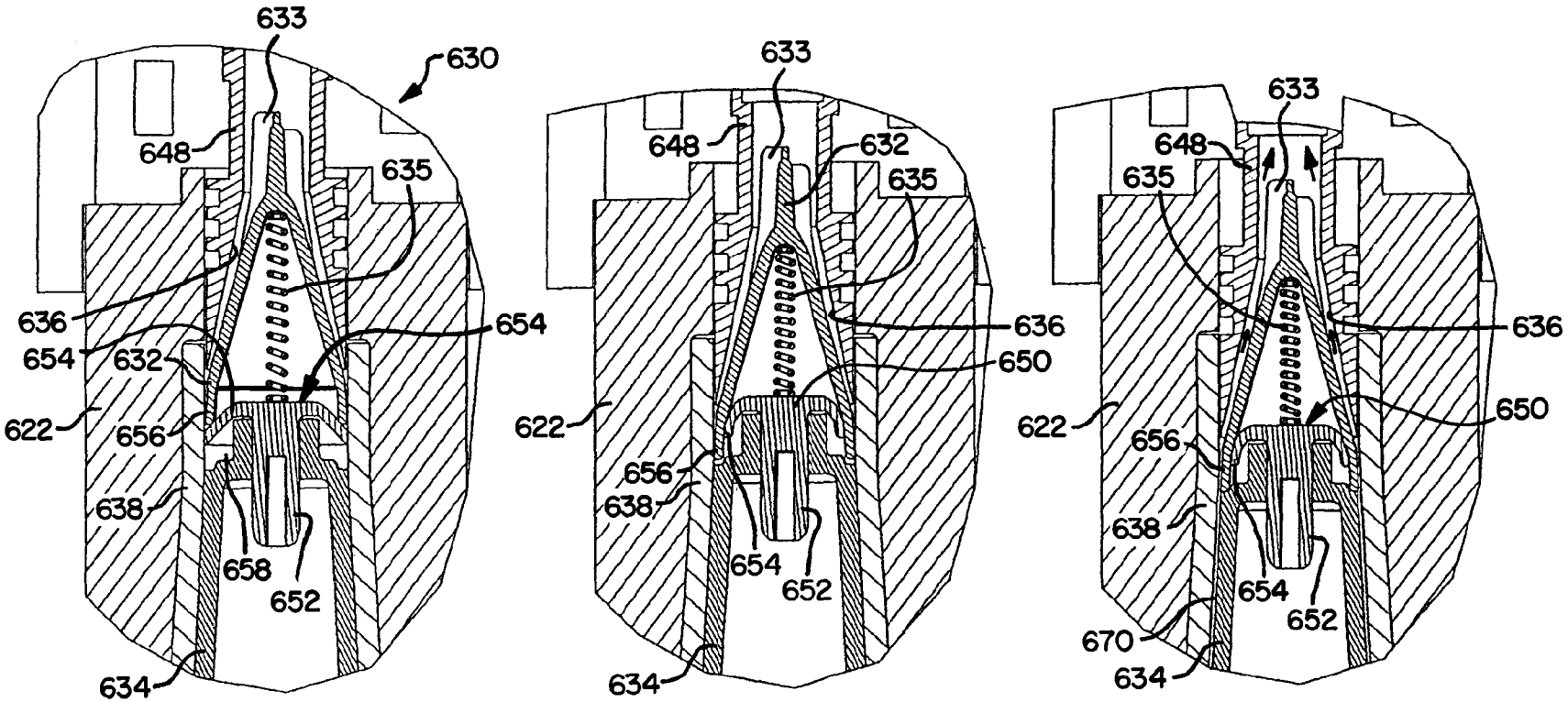
FIG. 6A is a partial cross-sectional view of a dispenser according to yet another embodiment of the present invention, showing a valve assembly in a first, closed position.
FIG. 6B is a partial cross-sectional view of the dispenser of FIG. 6A, showing the valve assembly in a second, partially open position.
FIG. 6C is a partial cross-sectional view of the dispenser of FIG. 6A, showing the valve assembly in a third, open position.

FIGS. 6A-6C depict a dispenser according to still another embodiment of the present invention. The dispenser of this embodiment is similar to the last embodiment in many respects. The dispenser comprises a dispenser body 622, which defines a flow passage, and a valve assembly 630. The valve assembly 630 comprises a first valve member 632 and a second valve member 634. In this embodiment, however, the first valve member 632 may or may not itself provide a substantial seal against flow of the liquid. As illustrated in FIGS. 6A-6C, the first valve member 632 is spaced, by protruding fins 633 or the like, from an inner surface 636 of the flow passage, so that the first valve member 632 does not seal against fluid flow through the flow passages. Instead, an umbrella seal 650 seals against an inner peripheral wall 638 of the valve body 622 as shown in FIG. 6A. The umbrella seal 650 has a stem 652, which fits in an aperture formed in the second valve member 634, and a radial flange 654, which extends radially and seals against the peripheral wall 638. In some instances, however, it may be desirable for the first valve member 632 to also seal against the interior of the flow passages, as in the previous embodiments.

A spring 635 is preferably disposed between the first and second valve members 632, 634, to maintain the first valve member 632 in a closed position. A second spring (also not shown) may be positioned in the dispenser body 622 to bias the second valve member 634 in a closed direction, if necessary or desired to maintain the valve in a closed position. In order to dispense the liquid, a user has only to manipulate an actuator (not shown).

When the user moves the actuator through a first range of motion, the actuator causes an actuator guide rod 648 to translate downward to engage the first valve member 632. As the first valve member 632 is pressed toward the second valve member 634, an outer edge 656 of the first valve member 632 forces the radial flange 654 of the umbrella seal 650 to retract into a cavity 658 formed between and/or within the first and second valve members 632, 634, as shown in FIG. 6B. In this retracted condition, the radial flange 654 no longer seals against the peripheral wall 638. Throughout the first range of motion, the liquid is still substantially prevented from flowing, due to the second valve member 634 engaging the peripheral wall 638.

As the user continues to depress the actuator through a second range of motion, the outer edge 656 of the first valve member 632 abuts the second valve member 634 and forces it away from the peripheral wall 638, as shown in FIG. 6C. A restrictive flow path 670 is defined by the gap between the second valve member 634 and the peripheral wall 638. During this second range of motion, liquid is allowed to flow through the restricted flow path 670, as shown by the arrows in FIG. 6C. The distance that the second valve member 634 is spaced from the peripheral wall 638 determines the size of the restricted flow path 670 and, thus, regulates the rate of liquid flow through the dispenser. The spacing of the second valve member 634 from the peripheral wall 638 is adjustable by moving the actuator within the second range of motion. Because the umbrella seal 650 in this embodiment is retracted into the cavity between the first and second valve members 632, 634 when the dispenser is actuated, the seal does not cause disruption of the liquid flow, thereby reducing foaming of the dispensed liquid. The liquid flowing through the restricted flow path 670 flows past the first valve member 632 and through the hollow guide rod 648 before being dispensed from a spout (not shown).

The dispenser components may be constructed of any material that is suitable for use with the dispensed liquid. Many suitable materials will be readily apparent to those of ordinary skill in the art. Likewise, the specific manufacturing techniques used to produce the various components are not important, suitable techniques being obvious to those skilled in the art. Preferably, however, the valve members and other components that are in direct contact with the liquid are made of a material that is substantially non-corrosive in the liquid, such as glass, polycarbonate, acrylic, polyethylene terephthalate (PET), polypropylene, stainless steel, polyvinyl carbonate (PVC), or the like. In the case of polymers and plastics, injection molding is the preferred method of construction. In addition, the umbrella seal is preferably made of an injection molded thermoplastic elastomer (TPE). The surfaces of the components that are exposed to the liquid are preferably constructed having a substantially smooth surface finish to prevent corrosion, pitting, and wear of the components. In addition, these components may be subjected to a surface treatment, such as a plasma treatment or a hydrophilic polymer coating process, to increase their surface energy. These surface treatments help reduce the amount of bubbles nucleated at the surface of the components, thereby maintaining more of the dissolved gas in the liquid. Of course any other method of surface treatment that increases the surface energy may also be used.

The dispenser may also include additional flow regulating or restricting components. One such component is a porous flow control-type flow regulator, in which liquid flow is restricted by forcing the liquid to flow through at least a portion of porous flow control member (the amount of restriction may be fixed or variable), as described in greater detail in U.S. patent application Ser. No. 11/081,280, filed Mar. 16, 2005, and entitled Dispenser Having A Porous Flow Control Member, which is fully incorporated herein by reference. Another flow regulating component is a long tube-type assembly, in which a long narrow tube is used to restrict and/or regulate the fluid flow rate using the head kiss over the length of the tube, as described in greater detail in the U.S. patent application Ser. No. 11/081,109, filed Mar. 16, 2005, and entitled Dispenser Mechanism Using Long Tubes to Vary Pressure Drop, which is also fully incorporated herein by reference. Each of the flow regulating and/or restricting features disclosed in the above-noted applications, can be used in combination with the embodiments disclosed herein. For example, it is envisioned that a dispenser might advantageously include any combination of one or more of a porous flow control member, a long tube, and a conical valve assembly. In on preferred combination a dispenser might include a porous flow control member or long tube serving as a fixed (i.e., non-variable) flow restrictor with a conical valve assembly serving as an adjustable flow regulator.

The present inventors also envision that the dispenser could be provided with an engaging element, such as a protrusion, indentation, slot, groove, notch, post, hook, or the like, to facilitate stacking of a plurality of dispensers and containers during storage and/or use.

While the invention is described in terms of the presently preferred embodiments, it is understood that the features of these embodiments could be rearranged, interchanged, and/or combined to achieve other variations of the present invention, without departing from the spirit and scope of the present invention. For example, the conical valve members are oriented in the drawings with the large end in the upstream direction and the tapered end in the downstream direction of the liquid flow; however, the valve members could also be reversed, so that the large end is in the downstream direction and the tapered end is in the upstream direction of liquid flow. Orienting the valve members with the large ends in the upstream direction (as shown in the drawing FIGS. 1, 2, 4, 5 and 6.) offers greater flow control and a self-energizing seal. Orienting the valve members with the large ends downstream, on the other hand, provides a smoother velocity profile of the dispensed liquid, thereby reducing the amount of the foaming.

Moreover, while the dispensing assemblies are disclosed for use on a pressurized beverage bottle, the present inventors anticipate various other uses for the various dispenser assemblies disclosed. Further, the various flow regulation portions, i.e., first and second valve members, dispenser bodies and seals, of the disclosed embodiments could be used without the additional structure required to adapt them for use with a pressurized beverage container. For example, the flow regulating portions may also be adapted for use in connection with blood oxygenation equipment, flow regulators, or any other application when it is desirable to control the flow of a liquid to provide a smooth, non-turbulent flow and/or when there is a concern about keeping dissolved gas(es) in solution. In particular, the inventors believe that the umbrella seal design of the present invention may be particularly applicable to medical applications, such as blood processing techniques, where very smooth flow is important to prevent clotting and the like.

We claim:

1. A dispenser comprising:

a dispenser body defining a flow passage;

a valve assembly disposed in said flow passage and comprising a first valve member and a second valve member, said second valve member having an elongated outermost surface extending radially and axially along a length of said second valve member in contact with an inner peripheral wall to control the flow rate of a liquid exiting through said flow passage, a spring disposed between the first and second valve members for maintaining the first valve member in a closed position; and an actuator coupled to said valve assembly configured to be manipulated through a first range of motion and a second range of motion, wherein only said first valve member is configured to be displaced upon the actuator being manipulated through the first range of motion, wherein, both said first and second valve members are configured to be displaced in unison upon said actuator being manipulated through the second range of motion, and wherein said first valve member directly abuts said second valve member during the second range of motion and wherein during the second range of motion the first valve member and the second valve member together form a continuous wall section that converges in an axial direction in the dispenser body and wherein the continuous wall section and an inner wall of the flow passage provide for a pathway for fluid within the dispenser body.

2. The dispenser according to claim 1, wherein the first valve member further comprises a seal comprising an umbrella seal having a central stem and a radial flange, said stem being coupled to said second valve member and said radial flange being biased outward to press and seal against a peripheral wall of said flow passage.

3. The dispenser according to claim 2, wherein said first valve member has an outer edge portion configured to depress said radial flange of said umbrella seal causing said radial flange to retract into a cavity formed between said first and second valve members.

4. The dispenser according to claim 1, wherein said flow passage has a conical peripheral wall, and at least one of said first and second valve members comprises a substantially conical body corresponding in shape to said conical peripheral wall of said flow passage and is configured to form an elongated passageway creating a variable, restrictive flow path between said conical peripheral wall of said flow passage and at least one of said first and second valve members.

5. The dispenser according to claim 1, wherein said flow passage has a valve seat and a conical peripheral wall, said first valve member further comprises a substantially conical body and is configured to sealingly engage said valve seat of said flow passage, and said second valve member further comprises a substantially conical body corresponding in shape to said conical peripheral wall of said flow passage and forms a variable, restrictive flow path between said conical peripheral wall and said second valve member.

6. The dispenser according to claim 5, wherein a gap of said restrictive flow path is adjustable to vary the resistance to flow of a liquid through said valve assembly.

7. The dispenser according to claim 6, wherein the dispenser is configured such that when said actuator is moved through the first range of motion, said first valve member is configured to disengage from said valve seat and be displaced toward said second valve member until said first valve member abuts said second valve member.

8. The dispenser according to claim 7, wherein when said actuator is configured to move through the second range of motion, said first valve member is configured to be pressed against said second valve member, to displace both said first and second valve members in unison and disengaging said second valve member from said conical peripheral wall.

9. The dispenser according to claim 5, further comprising a seal interposed between said first and second valve members, said seal being operable between an extended condition wherein said seal extends and seals against a peripheral wall of said flow passage and a retracted condition wherein said seal is retracted into a cavity formed between said first and second valve members.

10. The dispenser according to claim 1, further comprising a cap to which said actuator is mounted, said cap having a spout protruding therefrom for directing the dispensed liquid.

11. The dispenser according to claim 10, wherein said actuator comprises a lever which can be manipulated to control the rate at which the liquid is dispensed.

12. The dispenser according to claim 1, further comprising a container having an opening, said dispenser body being received in said opening of said container.

13. The dispenser according to claim 1 wherein the second valve member has a recess for receiving a portion the first valve member.

14. The dispenser according to claim 1 wherein the second valve member is formed frustoconical and has a hollow interior portion.

15. A dispenser comprising:

a dispenser body defining a flow passage and an inner peripheral wall;

a valve assembly disposed in said flow passage and comprising a first valve member and a second valve member, said first and said second valve members together form a continuous substantially conical body during dispensing and wherein said first and said second valve members correspond in shape along the length of said flow passage defined by the first and second valve members and the inner peripheral wall, said second valve member having an elongated contact surface extending radially and axially along the length of said second valve member in contact with the inner peripheral wall to control the flow rate of a liquid exiting through said flow passage, a spring disposed between the first and second valve members for maintaining the first valve member in a closed position and the second valve member having a recess for receiving a portion of the first valve member;

an actuator coupled to said valve assembly configured to be manipulated through a first range of motion and a second range of motion; and wherein the dispenser is configured such that when said actuator is moved through the first range of motion, said first valve member disengages from said flow passage and is displaced toward said second valve member until said first valve member abuts said second valve member.

16. The dispenser according to claim 15, wherein when said actuator is configured to move through the second range of motion, said first valve member is configured to be pressed against said second valve member, to displace both said first and second valve members in unison and disengaging said second valve member from said inner peripheral wall forming an elongated passageway creating a variable, restrictive flow path between said inner peripheral wall and at least one of said first and second valve members.

17. The dispenser according to claim 15, wherein only said first valve member is configured to be displaced upon the actuator being manipulated through the first range of motion, and wherein, both said first and second valve members are configured to be displaced in unison upon said actuator being manipulated through the second range of motion.

18. The dispenser according to claim 15 wherein the second valve member is formed frustoconical and has a hollow interior portion.

19. A dispenser comprising:

a dispenser body defining a flow passage;

a valve assembly disposed in said flow passage and comprising a first valve member and a second valve member, said second valve member having an elongated contact surface to control the flow rate of a liquid, a spring disposed between the first and second valve members for maintaining the first valve member in a closed position; and an actuator coupled to said valve assembly configured to be manipulated through a first range of motion and a second range of motion, wherein only said first valve member is configured to be displaced upon the actuator being manipulated through the first range of motion, wherein, both said first and second valve members are configured to be displaced in unison upon said actuator being manipulated through the second range of motion; and wherein said first valve member is configured to abut said second valve member, and wherein the first valve member further comprises a seal comprising an umbrella seal having a central stem and a radial flange, said stem being coupled to said second valve member and said radial flange being biased outward to press and seal against a peripheral wall of said flow passage.

20. A dispenser comprising:

a dispenser body defining a flow passage;

a valve assembly disposed in said flow passage and comprising a first valve member and a second valve member, said second valve member having an elongated contact surface to control the flow rate of a liquid, a spring disposed between the first and second valve members for maintaining the first valve member in a closed position; and an actuator coupled to said valve assembly configured to be manipulated through a first range of motion and a second range of motion, wherein only said first valve member is configured to be displaced upon the actuator being manipulated through the first range of motion, wherein, both said first and second valve members are configured to be displaced in unison upon said actuator being manipulated through the second range of motion, and wherein said first valve member is configured to abut said second valve member, wherein the first valve member further comprises a seal comprising an umbrella seal having a central stem and a radial flange, said stem being coupled to said second valve member and said radial flange being biased outward to press and seal against a peripheral wall of said flow passage, and wherein said first valve member has an outer edge portion configured to depress said radial flange of said umbrella seal causing said radial flange to retract into a cavity formed between said first and second valve members.

21. A dispenser comprising:

a dispenser body defining a flow passage;

a valve assembly disposed in said flow passage and comprising a first valve member and a second valve member, said second valve member having an elongated contact surface to control the flow rate of a liquid, a spring disposed between the first and second valve members for maintaining the first valve member in a closed position;

an actuator coupled to said valve assembly configured to be manipulated through a first range of motion and a second range of motion, wherein only said first valve member is configured to be displaced upon the actuator being manipulated through the first range of motion, wherein, both said first and second valve members are configured to be displaced in unison upon said actuator being manipulated through the second range of motion, and wherein said first valve member is configured to abut said second valve member;

wherein said flow passage has a valve seat and a conical peripheral wall, said first valve member further comprises a substantially conical body and is configured to sealingly engage said valve seat of said flow passage, and said second valve member further comprises a substantially conical body corresponding in shape to said conical peripheral wall of said flow passage and forms a variable, restrictive flow path between said conical peripheral wall and said second valve member; and a seal interposed between said first and second valve members, said seal being operable between an extended condition wherein said seal extends and seals against a peripheral wall of said flow passage and a retracted condition wherein said seal is retracted into a cavity formed between said first and second valve members.

* * * * *